United States Patent [19]

Robb et al.

[11] 4,406,581

[45] Sep. 27, 1983

[54] SHROUDED FAN ASSEMBLY

[75] Inventors: Neil E. Robb, Jackson; Thomas G. Gorman, Hanover, both of Mich.

[73] Assignee: Hayes-Albion Corp., Jackson, Mich.

[21] Appl. No.: 221,431

[22] Filed: Dec. 30, 1980

[51] Int. Cl.[3] ..... F04D 25/16

[52] U.S. Cl. ..... 415/172 A; 123/41.49; 277/57; 416/228

[58] Field of Search ..... 415/172 R, 172 A, DIG. 1, 415/210; 165/51, 122; 277/53, 57; 416/228 R, 223 R, 231 B, 169 A; 123/41.49

[56] References Cited

U.S. PATENT DOCUMENTS 3,574,480 4/1971 Hoepfner ..... 416/228
3,635,285 1/1972 Davis .
3,680,977 8/1972 Rabouyt et al. .
3,842,902 10/1974 Poslusny .
4,131,156 12/1978 Crumrine, Jr. et al. .
4,181,172 1/1980 Longhouse .
4,213,426 7/1980 Longhouse .

*Primary Examiner*—Billy J. Wilhite
*Attorney, Agent, or Firm*—Hume, Clement, Brinks, Willian & Olds, Ltd.

[57] ABSTRACT

An improved shrouded fan assembly (10, 10') is disclosed which forms a labyrinthian seal between a plurality of fan blades (20, 20') and an annular ring (16, 16') mounted to a non-rotating shroud (15, 15') without the use of a rotating annular shroud. The tip of at least one fan blade (20, 20') defines a slot (21, 21') adapted to receive the annular ring (16, 16') to form a labyrinthian seal therewith. The improvement increases fan efficiency by decreasing undesirable air flows in the shroud gap between the shroud (15, 15') and the tips of the fan blades (20, 20').

17 Claims, 7 Drawing Figures

SHROUDED FAN ASSEMBLY

BACKGROUND OF THE INVENTION

This invention relates to improvements in shrouded fan assemblies, for example in cooling fan assemblies used to move air through automotive radiators.

In many applications, the space available for mounting a fan is confined, requiring the use of a small fan, while the fanning capacity required dictates the use of a large fan.

For example, the automobile space engine compartment is being reduced in size with the reduction in the overall size of automobiles, leaving less and less room for the mounting of a cooling fan. Furthermore, various control devices and options such as air conditioning reduce the room available for mounting a fan, while at the same time they increase the demand for cooling capacity which the fan must meet.

It is therefore increasingly important to maximize the fanning capacity of a fan of a given size, and fan efficiency has therefore become a crucial design consideration.

Fan efficiency losses occur in large part due to undesirable airflow around the tips of fan blades in the gap which exists between the fan blade tips and a wall which surrounds the rotating fan. The undesirable airflow can generally be described as backflow of air from the exhaust side to the intake side of the fan, recirculation of air in vortex patterns inside the gap, and localized backflow over each fan blade tip from the pressure side to the suction side of the blade. These flows produce no useful cooling air flow, cause fan noise, and lower fan efficiency.

Various designs have been proposed for increasing fan efficiency by reducing these flows. The designs generally involve an interruption or decrease in the size of the gap. Losses have been reduced by fan designs that work with a stationary shroud, or by modifications of the fan blades such as bent back tips, winglets and guide vanes.

One approach of the prior art has been to mount a rotating annular shroud to the fan blade tips and then to position this rotating shroud against a stationary shroud in a labyrinthian or some other configuration, as shown in U.S. Pat. No. 3,842,902. While effective at reducing the undesirable air flow, this design suffers from certain disadvantages. Provisions must be made for mounting the rotating shroud onto the blade tips and for assuring that the shroud will remain mounted during rotation at high speed. Care must be taken that the rotating shroud and the blade assembly that the rotating shroud is mounted to are true, so that the fan does not undergo excessive oscillations during operation. Also, fan blade vibration causes stresses to develop at the areas of attachment of the rotating shroud to the blades. These design considerations increase the cost of implementing the rotating shroud approach.

SUMMARY OF THE INVENTION

This invention is directed to overcoming the disadvantages of the prior art. The invention presents improvements in shrouded fan assemblies which include a fan blade assembly having a plurality of fan blades and a non-rotating fan shroud encircling the fan blade assembly.

According to this invention, an annular ring is mounted to the fan shroud, and at least one of the plurality of fan blades is shaped and disposed to form a labyrinthian crossing with the annular ring. The fan blades do not carry a rotating annular shroud.

Preferably at least one, and most preferably each one of the plurality of fan blades defines a slot in the tip section of the blade. The slot is adapted to movably receive the annular ring to form a labyrinthian seal therewith at the blade tip.

As used in this application the term "labyrinthian" seal or crossing characterizes an overlap between the fan blade and the annular ring such that the one is partly disposed within the other. Preferably, the labyrinthian seal or crossing is characterized as one where a slot in the tip section of a blade receives the annular ring to create an obstacle to air flow over the blade tip such that air flow in the plane of the blade tip at the blade tip is blocked from flowing from one side of the fan to the other along a straight path.

The invention uses air flow interference between the blade tip and the annular ring created by their arrangement in a labyrinthian seal to effectively block and break up the undesired air flows. By reducing the undesired airflows, the concurrent benefits of reduced noise, increased desirable airflow, and improved fan efficiency are realized. By eliminating the use of a rotating annular shroud, the invention avoids the disadvantages of the rotating shroud systems, as discussed above.

The invention itself, together with further objects and attendant advantages, will be best understood by reference to the following detailed description taken in connection with the accompanying drawings.

DETAILED DESCRIPTION OF THE PREFERRED EMBODIMENTS

Figure 2:
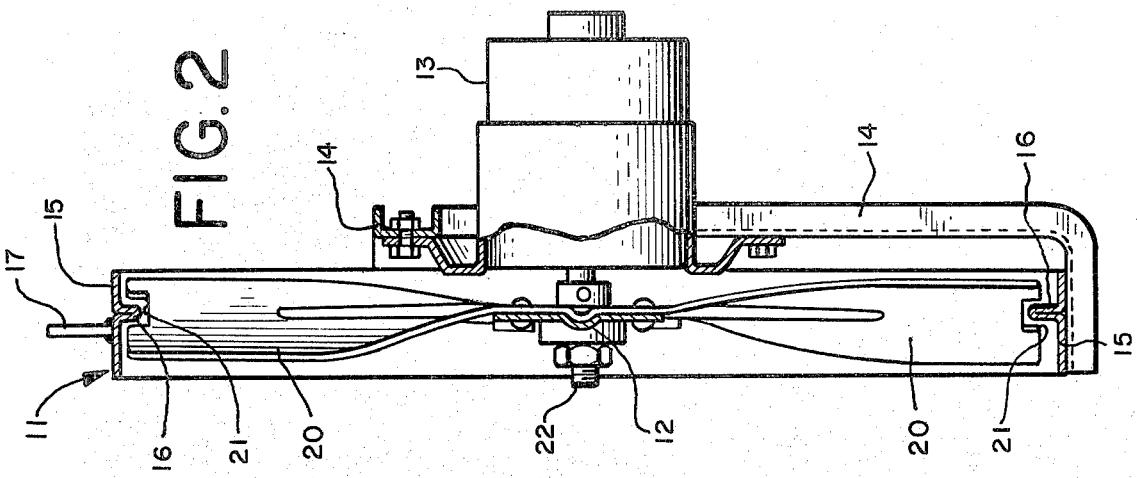
FIG. 2 is a sectional view of the shrouded fan assembly taken along line 2—2 of FIG. 1.
Figure 3A:
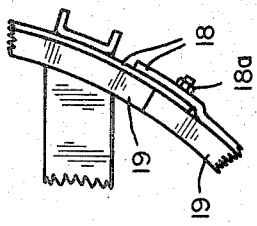
FIG. 3*a* is a fragmented front view of a portion of a modified version of the first preferred embodiment of FIG. 1.
Figure 3:
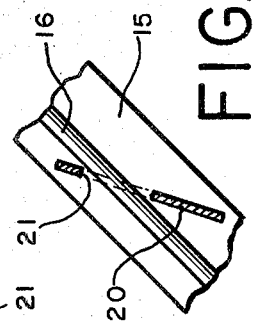
FIG. 3 is a fragmented sectional view of a labyrinthian seal of the shrouded fan assembly taken along line 3—3 of FIG. 1.
Figure 1:
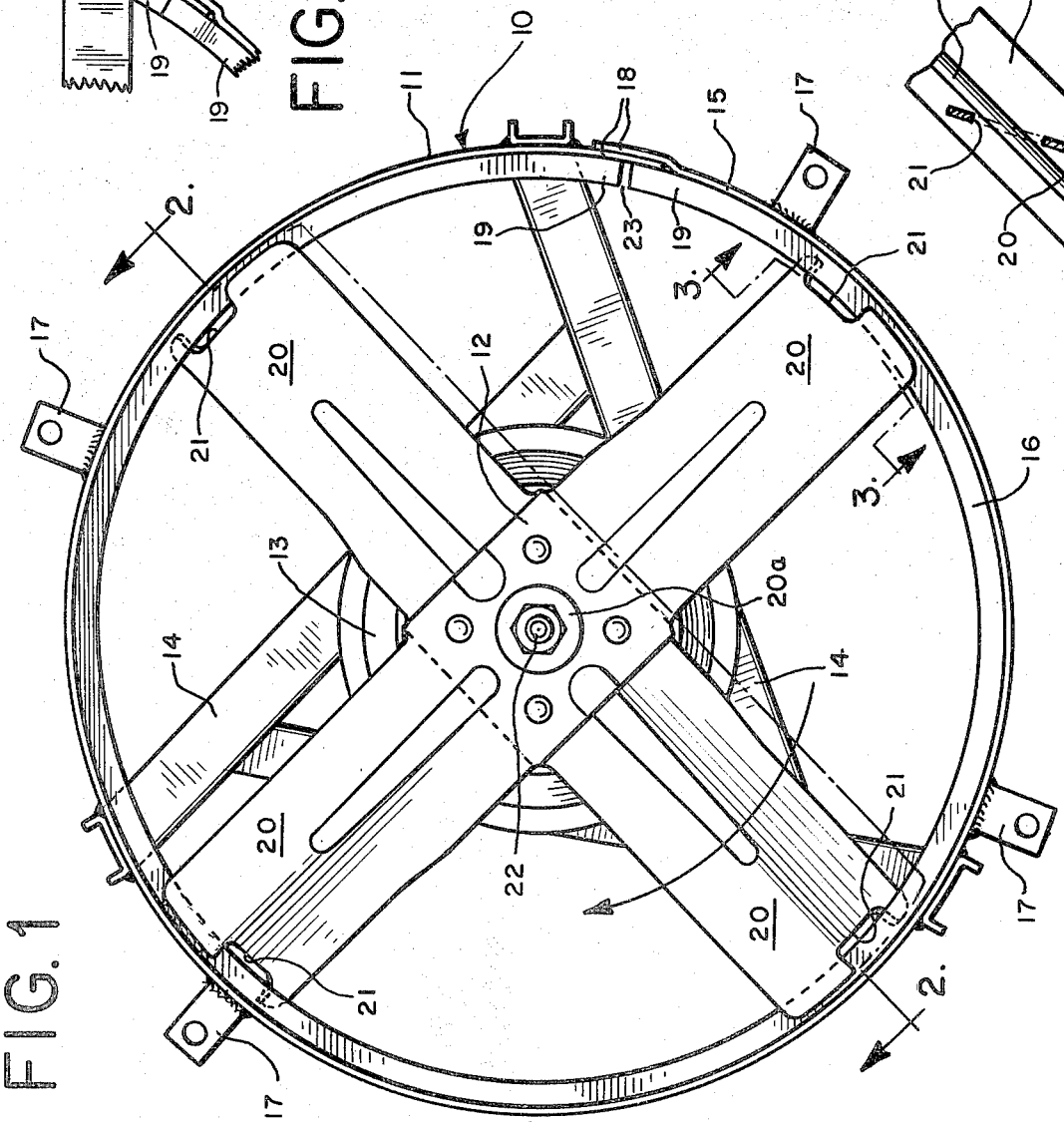
FIG. 1 is a front view of a shrouded fan assembly including a first preferred embodiment of the invention.

Referring now to the drawings, FIGS. 1-3 show an improved shrouded fan assembly 10 which includes a first preferred embodiment of the present invention. As shown in FIG. 1, the fan assembly 10 includes a fan shroud assembly 11, a fan blade assembly 12, a motor 13, and a motor mount 14.

The fan shroud assembly 11 includes a shroud 15, an annular ring 16 and mounting brackets 17 for mounting the fan assembly 10 onto a surface. The shroud 15 is a strip of sheet metal formed into a circular ring. End portions 18 of the shroud strip overlap and are connected together, either fixedly such as by being welded together, or separably such as by being bolted together.

The shroud 15 carries on its inner surface the annular ring 16, which is a curved strip of sheet metal which forms a circle and which extends radially inwardly from the shroud 15 such that the cross-section of the fan shroud assembly 11 is substantially T-shaped, with the shroud 15 forming the top and the ring 16 forming the leg of the T, as shown in FIG. 2. The ring 16 can be formed integrally with the shroud 15 by being formed from the same strip of sheet metal as the shroud 15, as shown in FIG. 2. Alternatively, the ring 16 can be formed separately and then attached to the shroud 15 by suitable means such that an edge portion of the ring 16 extends radially inwardly from the shroud 15.

In a fan assembly utilizing a shroud 15 whose end portions 18 are inseparably joined together, the end portions 19 of the annular ring 16 define a gap 23 between them, as shown in FIG. 1. The purpose of the gap 23 is to allow the fan blade assembly 12 to be mounted inside the shroud assembly 11 even though the tips of the fan blades 20 overlap the annular ring 16, as shown in FIGS. 1 and 2. The gap 23 is sized to allow the tips of the blades 20 to pass therethrough. A shroud 15 whose end portions 18 are inseparably joined together may utilize an annular ring 16 which is detachable from the shroud 15 and whose end portions 19 join together but are separable. The fan blade assembly 11 is then inserted inside the ring 16 before the ring 16 is mounted on the shroud 15.

In a fan assembly utilizing a shroud 15 whose end portions 18 are separably joined together by a fastener 18*a* (FIG. 3*a*), the end portions 19 of the annular ring 16 preferably abut or overlap each other. The mounting of the fan blade assembly 12 inside the shroud assembly 11 is accomplished by disconnecting the shroud end portions 18 from each other, stretching the shroud assembly 11 to increase its diameter sufficiently to allow the insertion of the fan blade assembly 12 therein, reclosing the shroud assembly 11, and reconnecting the shroud end portions 18.

Alternatively, a fan assembly may utilize both a shroud 15 whose end portions 18 are inseparably joined together and an annular ring 16 whose end portions 19 abut or overlap each other if the annular ring 16 or the fan blades 20, or both, are made flexible. Then the mounting of the fan blade assembly 12 inside the shroud assembly 11 is accomplished by flexing the ring 16 and/or the blades 20 sufficiently to allow the fan blade assembly 12 to be inserted into the shroud assembly 11 and then releasing the flexed ring 16 and/or the flexed blades 20 so that the blade tip slots 21 may receive the ring 16.

The fan blade assembly 12 of this preferred embodiment includes four fan blades 20 extending radially from a central hub 20*a*. The blades 20 are symmetrically arranged around the central hub 20*a* and they are attached to each other at the central hub 20*a*. The blades 20 are formed from strips of sheet metal that are twisted along their length, such that the sheet of each blade 20 is substantially parallel to the plane of the fan shroud assembly 11 at the central hub 20*a* but substantially slanted with respect to that plane at the blade tip, as shown in FIG. 3. The outer tip portion of each blade 20 defines a slot 21 sized and shaped to freely receive the annular ring 16. The blade assembly 12 is rotatably mounted inside the shroud assembly 11 such that the shroud assembly 11 surrounds or encircles the blade assembly 12 and the tip slot 21 of each blade 20 receives the annular ring 16 to form a labyrinthian seal or crossing therewith at the tip of the blade 20.

In an alternative construction only some of the fan blades 20 may define a slot 21. The fan blades 20 which do not define a slot 21 are made shorter to fit within the circle formed by the annular ring 16.

At the central hub 20*a* the fan blade assembly 12 is mounted to a shaft 22 of the motor 13. The motor 13 and the fan blade assembly 12 are held in position relative to the fan shroud assembly 11 by means of the motor mount 14 which extends between the motor 13 and the shroud 15 and which fixedly attaches the motor 13 to the shroud 15.

Alternatively, the motor 13 may be mounted separately from the fan shroud assembly 11. Spacing which exists between the surfaces of the annular ring 16 and the surfaces of the tips of the blades 20 allows for some relative translational movement between the fan shroud assembly 11 and the fan blade assembly 12. Therefore, the motor 13 with the fan blade assembly 12 attached thereto may be mounted apart from the fan shroud assembly 12, where it may undergo some vibration or other movement with respect thereto.

During operation of the shrouded fan 10, the blade assembly 12 rotates relative to the shroud assembly 11 and causes air flow through the fan 10. Air flow interference is created between the annular ring 16 and tips of the rotating blades 20 due to their arrangement in labyrinthian seals for as the air attempts to flow from the exhaust to the intake side of the fan along a direct path around the blade tips it encounters the substantial barrier created by the blade tips and the annular ring. The interference results in the blocking and the breakup of the undesirable airflows around the blade tips. Fan noise is thereby reduced, desirable airflow is increased, and fan efficiency is improved.

While the shrouded fan 10 finds ready application in automotive cooling, it is not limited in use thereto. Rather, the benefits of utilizing the fan 10 may be obtained in a wide variety of applications, including motor cooling, air conditioners and dehumidifiers, kitchen exhaust hoods and forced air furnaces. Likewise, though the shrouded fan assembly 10 is shown as including its own motor 13, the fan blade assembly 12 may be driven in any number of ways, such as directly by an automobile engine, by a motor being cooled by the fan 10, or by an external drive source through a system of idler pulleys. The shrouded fan assembly 10 is versatile in both application and structure.

Figure 5:
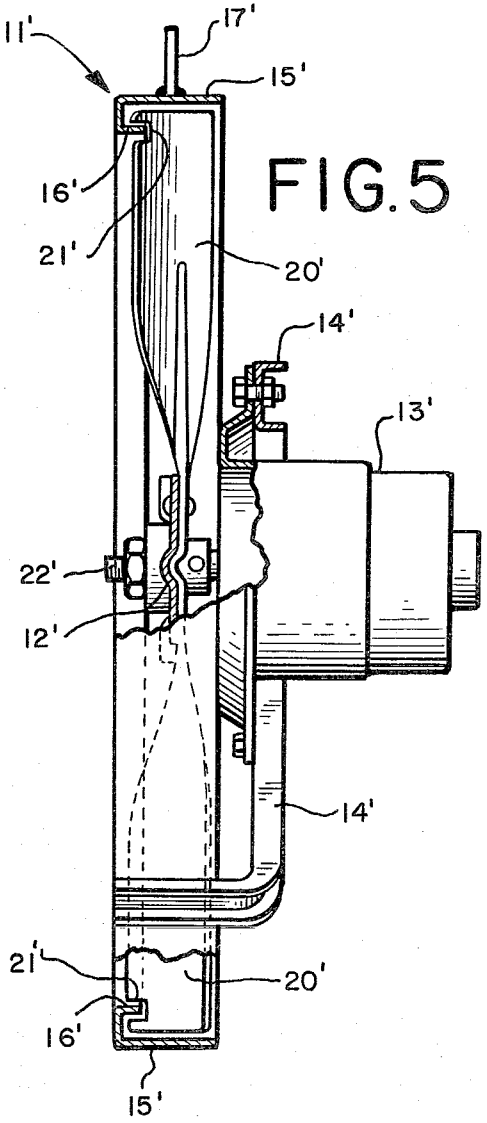
FIG. 5 is a sectional view of the shrouded fan assembly taken along line 5—5 of FIG. 4.
Figure 4:
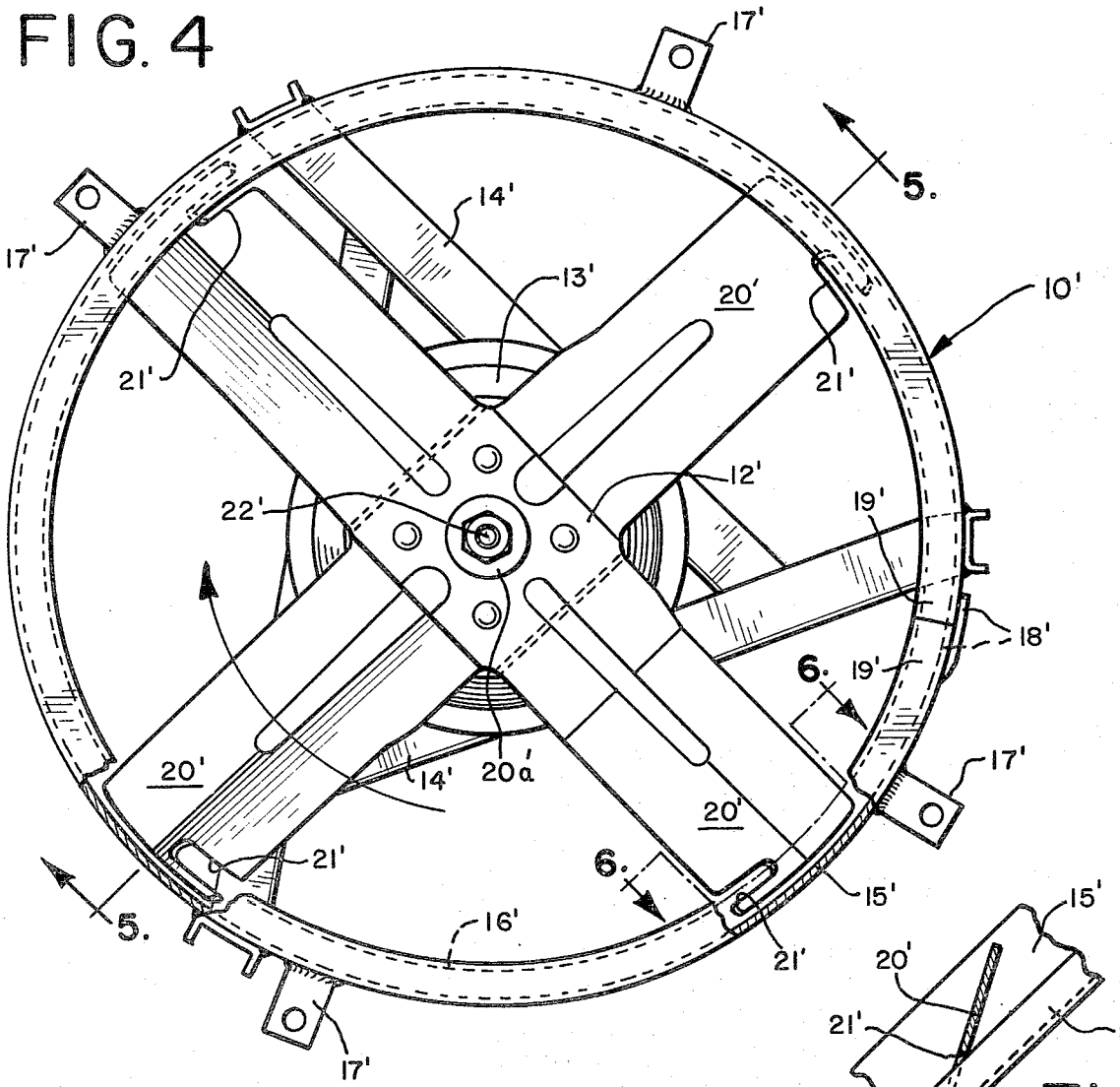
FIG. 4 is a front view of a shrouded fan assembly including a second preferred embodiment of the invention.
Figure 6:
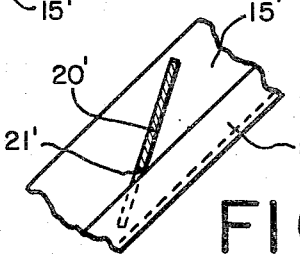
FIG. 6 is a fragmented sectional view of a labyrinthian seal of the shrouded fan assembly taken along line 6—6 of FIG. 4.

FIGS. 4–6 show an improved shrouded fan assembly 10' which includes a second preferred embodiment of the present invention.

The prime numbers in FIGS. 4–6 designate parts analogous to those designated by the unprimed numbers in FIGS. 1–3. Because FIGS. 1–3 and 4–6 are similar, a detailed discussion of FIGS. 4–6 would add little to the understanding of the invention. Therefore only the differences of the embodiment of FIGS. 4–6 from the embodiment of FIGS. 1–3 will be discussed.

The primary difference between the improved shrouded fan assemblies 10 and 10' is the configuration of the annular rings 16, 16' and the tip slots 21, 21'. As shown in FIG. 4, the annular ring 16' is a strip of sheet metal formed into an L-shaped cross-section and curved along its length to form a circle. The ring 16' is carried by the periphery of the shroud 15' with one leg of the "L" of ring 16' extending radially inwardly from the shroud 15' and the other leg of the "L" extending laterally toward the fan blade assembly 12' such that the cross-section of the fan shroud assembly 11' is substantially C-shaped, as shown in FIG. 5. The ring 16' can be formed integrally with the shroud 15' by being formed out of the same strip of sheet metal with the shroud 15', as shown in FIG. 5. Alternatively, the ring 16' can be formed separately from the shroud 15 and then attached to the shroud 15' by suitable means such that an edge portion of the ring 16' extends laterally toward the fan blade assembly 12'.

The tip portion of each blade 20' defines a slot 21' in the side of the blade 20' which slot is sized and shaped to freely receive the annular ring 16' such that when the blade assembly 12' is mounted inside the shroud assembly 11', the tip slot 21' of each blade 20' receives the annular ring 16' and forms a labyrinthian seal or crossing therewith.

Alternatively, only some of the fan blades 20' may define a slot 21'. The fan blades 20' which do not define a slot 21' are made either shorter to fit within the circle formed by the annular ring 16', or tapered along one edge to evade the annular ring 16'.

The labyrinthian seal in this embodiment is preferably located on the intake side of the fan.

The embodiment of the invention shown in FIGS. 4–6 has the additional advantage that the annular ring 16' poses no obstacle to the mounting of the fan assembly 12' inside the shroud assembly 11'; hence, there is no need to have a gap between ring end portions 19' or to make shroud end portions 18' separable.

Of course, it should be understood that various changes and modifications to the preferred embodiments described above will be apparent to those skilled in the art. For example, the shape and orientation of the annular ring, and correspondingly the shape and orientation of the tip slots, may be varied. The shrouded fan assembly may be constructed of material other than metal, such as plastic. The annular ring may be made flexible. Or the annular ring may overlap the fan blades, with the blade tips disposed within the ring. These and other changes and modifications can be made without departing from the spirit or scope of the present invention.

We claim:

1. An improved shrouded fan assembly comprising:
a fan shroud;
an annular ring mounted to the fan shroud; and
a fan blade assembly encircled by the fan shroud, the fan blade assembly having a plurality of fan blades, each having a respective blade tip; and
means for forming a labyrinthian seal between the fan blade assembly and the ring only in the region of at least one of the blade tips and not between the blade tips, said means comprising an edge portion of said at least one of the blade tips shaped and positioned to overlap the ring and thereby to form a labyrinth seal therewith, the fan blade assembly being spaced from the annular ring in the region between the blade tips by an amount sufficient to preclude a labyrinthian seal between the fan blade assembly and the ring in the region between the blade tips.

2. The apparatus of claim 1 wherein the seal forming means comprises means, included in each one of the plurality of fan blades, for defining a respective slot positioned to overlap with the annular ring to form a labyrinthian crossing with the annular ring at each blade tip.

3. The apparatus of claim 2 wherein the fan shroud and the annular ring each have end portions separably joined together for enabling the fan shroud and the annular ring to be opened and closed to allow the annular ring to be inserted in the fan blade slots.

4. The apparatus of claim 2 wherein the fan blades are flexible for enabling the annular ring to be inserted in the fan blade slots.

5. The apparatus of claim 2 wherein the annular ring defines a gap for enabling the annular ring to be inserted in the fan blade slots.

6. An improved shrouded fan assembly comprising:
a fan shroud;
a fan blade assembly encircled by the fan shroud, the fan blade assembly having a plurality of fan blades wherein each of the plurality of fan blades defines a slot in the tip section of the respective blade, said tip sections each being integrally formed in one piece with the respective blade; and
an annular ring secured to the fan shroud, the ring movably received and partially disposed within the blade slots such that a labyrinthian seal is formed between the ring and the blade tips, and the tip sections of the blades are positioned directly adjacent the ring, the plurality of fan blades being free of interconnections therebetween adjacent the ring such that no seal is formed with the ring between the plurality of fan blades.

7. The apparatus of claim 6 wherein the annular ring includes an edge portion extending radially toward the fan assembly.

8. The apparatus of claim 7 wherein the fan shroud and the annular ring each have end portions separably joined together for enabling the fan shroud and the annular ring to be opened and closed to allow the annular ring to be inserted in the fan blade slots.

9. The apparatus of claim 7 wherein the fan blades are flexible for enabling the annular ring to be inserted in the fan blade slots.

10. The apparatus of claim 7 wherein the annular ring defines a gap for enabling the annular ring to be inserted in the fan blade slots.

11. The apparatus of claim 7 wherein the annular ring is planar.

12. The apparatus of claim 6 wherein the annular ring includes an edge portion extending laterally toward the fan assembly.

13. The apparatus of claim 12 wherein the annular ring is L-shaped.

14. The apparatus of claim 6 wherein the annular ring it L-shaped.

15. A shrouded fan assembly comprising:
a fan blade assembly having a plurality of fan blades extending radially from a central hub, each one of the plurality of fan blades defining a slot in the tip section of the blade, the slot facing radially outwardly from each blade, wherein each of the tip sections is integrally formed in one piece with the respective blade and is shaped to move fluid past the fan assembly when rotated; and
means for forming a labyrinthian seal with the fan blade assembly only in the region of the blade tips and not between the blade tips, said means comprising a non-rotating fan shroud encircling the fan blade assembly, the shroud having an annular ring mounted thereto, the ring having a planar edge portion extending radially toward the fan assembly, the ring edge portion movably received and partially disposed within each blade slot to form a labyrinthian seal at each blade tip, the fan blade assembly being spaced from the ring edge portion in the region between the blade tips by an amount sufficient to preclude a labyrinthian seal between the fan blade assembly and the ring edge portion in the region between the blade tips.

16. A shrouded fan assembly comprising:

a fan blade assembly having a plurality of fan blades extending radially from a central hub, each one of the plurality of fan blades defining a slot in the tip section of the blade, the slot facing laterally outwardly from each blade, wherein each of the tip sections is integrally formed in one piece with the respective blade and is shaped to move fluid past the fan assembly when rotated; and means for forming a labyrinthian seal with the fan blade assembly only in the region of the blade tips and not between the blade tips, said means comprising a non-rotating fan shroud encircling the fan blade assembly, the shroud having an annular ring mounted thereto, the ring extending toward the fan assembly and having an edge portion extending laterally toward the fan assembly, the ring edge portion movably received and partially disposed within each blade slot to form a labyrinthian seal at each blade tip, the fan blade assembly being spaced from the ring edge portion in the region between the blade tips by an amount sufficient to preclude a labyrinthian seal between the fan blade assembly and the ring edge portion in the region between the blade tips.

17. The apparatus of claim 1 or 6 or 15 or 16, further comprising:

a motor mounted to the fan shroud, the motor rotating a shaft having the fan assembly mounted thereon.

* * * * *